US005511935A

United States Patent [19]

Seefeldt

[11] Patent Number: 5,511,935

[45] Date of Patent: Apr. 30, 1996

[54] PAPER STACK CONVEYOR

[75] Inventor: Joachim Seefeldt, Neuffen, Germany

[73] Assignee: bielomatik Leuze GmbH & Co., Germany

[21] Appl. No.: 295,156

[22] Filed: Aug. 24, 1994

Related U.S. Application Data

[63] Continuation of Ser. No. 729,043, Jul. 12, 1991, abandoned.

[30] Foreign Application Priority Data

Jul. 13, 1990 [DE] Germany ..... 40 22 350.7

[51] Int. Cl.[6] ..... B65G 57/09

[52] U.S. Cl. ..... 414/791.1; 414/786; 414/793.4

[58] Field of Search ..... 414/790.9, 790.7, 414/791.1, 793.4, 794.4, 786

[56] References Cited

U.S. PATENT DOCUMENTS

| | | | |
|---|---|---|---|
| 3,672,265 | 6/1972 | Schwarzkopf | 414/790.7 |
| 4,300,420 | 11/1981 | Haenni | 414/793.4 X |
| 4,367,999 | 1/1983 | Benuzzi | 414/790.9 |
| 4,576,536 | 3/1986 | Benuzzi | 414/790.9 |
| 5,013,211 | 5/1991 | Nakaoda et al. | 414/794.4 X |

FOREIGN PATENT DOCUMENTS

| | | | |
|---|---|---|---|
| 1107674 | 5/1961 | Germany . | |
| 1112536 | 8/1961 | Germany . | |
| 1241466 | 6/1967 | Germany . | |
| 1294881 | 5/1969 | Germany . | |
| 2010153 | 12/1971 | Germany . | |
| 2330569 | 1/1974 | Germany . | |
| 2323432 | 11/1974 | Germany . | |
| 2803223 | 7/1978 | Germany . | |
| 2724980 | 11/1978 | Germany . | |
| 2815829 | 10/1979 | Germany . | |
| 3220095 | 12/1983 | Germany . | |
| 3930416 | 5/1990 | Germany . | |
| 52-39257 | 3/1977 | Japan | 414/793.4 |
| 218227 | 10/1985 | Japan | 414/793.4 |

*Primary Examiner*—William E. Terrell
*Assistant Examiner*—Janice L. Krizek
*Attorney, Agent, or Firm*—Quarles & Brady

[57] ABSTRACT

At the end of a paper processing machine, a layer stack formed there is gripped by a gripper (16) and is delivered through a shorter linear movement either to a first transverse conveyor (24), or through a longer linear movement to a subsequent second transverse conveyor (25). Thus, during discharge with the particular transverse conveyor (24, 25), the other transverse conveyor (25, 24) can be loaded with a single or several sheet stacks. for overtravelling the first transverse conveyor (24) with a sheet stack, a moving bridge (20) is provided having bridge parts (44, 45), which project toward each other and are movable, and whereof one bridge part (45) simultaneously forms a support arm (64) for supporting the layer unit prior to deposition on the second transverse conveyor (25). This construction permits a very high discharge capacity and simultaneously varyingly high stacks can be collected and conveyed away.

41 Claims, 3 Drawing Sheets

1a
25a
24a
66

1b
25b
24b 1c
25c
24c
25c 1
2
3
4
5
6
7
11
12

PAPER STACK CONVEYOR

This is a continuation of application Ser. No. 07/729,043, filed Jul. 12, 1991, now abandoned.

FIELD OF THE INVENTION

The invention relates to a conveyor means for layer units, particularly flat sheet layers, which singly or multiply rest flush on one another and which are conveyed, brought together or supplied to further treatment processes in the form of layer stacks.

BACKGROUND OF THE INVENTION

During paper processing, a plurality of superimposed paper webs can be initially subdivided with longitudinal cutters into several size-maintaining useful widths and can then be subdivided by means of a cross cutter into individual, juxtaposed sheet layers, and optionally, can be supplied to further operating stations and finally stacked in juxtaposed manner to form layer stacks, which normally have roughly 500 individual layers and which are referred to as reams. These juxtaposed layer stacks, over the width of the paper webs, are then transferred by a delivery means to the transfer station of a transverse conveyor and discharged to a packing machine or the like.

In the case of DE-OS 32 20 095, the layer stacks are gripped by a gripper conveyor at the front end in the delivery direction, are drawn on to a lowerable lifting table, optionally stacked to form larger overall stacks, and are then conveyed away, which permits faster working. However, it has been found that the working speed of the supplying paper processing machine can be further increased, so that there is a need for a corresponding capacity rise of the associated conveyor means.

SUMMARY OF THE INVENTION

An object of the invention is to provide a conveyor means of the aforementioned type, which avoids the disadvantages of known constructions and which in particular permits a further increase of the working speed and different further treatments to the transferred layer stack in simple manner.

According to the invention, this object is achieved in that means are provided for conveying at least one layer unit from optionally juxtaposed, incoming layer units to at least one associated transfer station and over and beyond the same, independently of whether the transfer station is or is not already occupied by one or more layer stacks. This transfer station to be bypassed is usually that which is first reached by the layer stack in the delivery direction. Therefore, the particular layer stack can be either deposited by means of the delivery means in the transfer station or can be conveyed beyond the same for a different use, e.g., into a further transfer station where deposition takes place. Thus, it has been found that the working cycle time of a discharging means, particularly for layer stacks, cannot be increased in the same way as the cycle time for the supplying process machine and the delivery means because excessively high discharging speeds create a tendency for the upper individual layers to be raised by the airflow or the like or for layer stacks to become askew due to excessive accelerations. This disadvantage also occurs if two transverse conveyors lead away from one longitudinal conveyor in such a way that the second transfer station in the longitudinal conveyor direction can only be occupied with a layer stack if the first transfer station is free. In this case, successive layer stacks in the longitudinal conveying direction are successively pairwise brought into the vicinity of the transverse conveyors and then transversely conveyed away.

According to the invention, only the furthest forward or the juxtaposed furthest forward individual stacks are taken over by the delivery means and conveyed towards the transfer station. In order to be able to obviate complicated construction of the conveyor means, the delivery means does not drive the layer stack in the same way as a belt conveyor or the like through a movable running path. Instead, the drive is formed by conveying means separate from the optionally stationary running path, which acts on the layer unit substantially over the height thereof and preferably is at least partly located above the running path.

So as to ensure that, when bypassing the transfer station with the layer unit, at the most insignificantly increased bypassing distances have to be covered, the layer stack is appropriately moved beyond or through the particular transfer station. Thus, the delivery means can perform an optionally reversing linear movement, which is preferably linear in one or both opposite directions, which permits a very simple construction. For this purpose, two or more transfer stations are arranged successively in substantially aligned manner in the delivery means direction, so that the supplied layer unit can be deposited in each random transfer station. For bypassing purposes, the layer unit does not have to be guided on a bypassing arc either in the height direction, or in the lateral direction. Bypassing is particularly simple if, in the direction of the discharging means, successive transfer stations are interconnected by means of substantially linear, planar or horizontal running paths for the layer units. Bypassing is also simple if the support for the transfer station is raisable or lowerable during the operation by means of a control mechanism by an amount which is at least as large than the height of the particular layer unit. Thus, the transfer station can form a height-adjustable depositing shaft with a fixed top, over which it is easy to travel.

According to a particularly advantageous further development, a moving bridge is movable on or over the top of the transfer station or the layer unit located therein, and the layer unit can run on it to pass over said transfer station. The moving bridge can cover the transfer station in the overtravel position either completely or only partly, in grating or grid-like manner, and the bridge appropriately is continuously connected to at least one of the boundaries of the transfer station at right angles to the delivery means direction. The moving bridge keeps the support below it or the layer unit above it separated from the overtravelling layer unit.

For the movement of at least one part of the moving bridge between its overtravelling position and a normal position that frees the transfer station, it is necessary to provide a movement direction approximately parallel to a movement direction at right angle to the delivery means direction. If the bridge part extends from the transfer station side first reached by the layer unit in the delivery means direction, it can be moved by corresponding control means roughly synchronously with the layer unit located thereon in the direction of the delivery means, so as to-ensure a very carefully handling of the layer unit.

Simultaneously, prior to being reached by the overtravelling layer unit, a bridge part can also be extended from the opposite side. The moving bridge, or at least part thereof, consequently does not have to be moved over the entire associated extension of the transfer station, and instead, this need only take place over a portion thereof.

Particularly if successive, adjacent transfer stations have a relatively small distance from one another, and this distance is e.g. only roughly the same as the associated extension of a transfer station or smaller, the moving bridge or a part thereof can be slid over each of these two adjacent transfer stations.

If at least one or all the transfer stations of a delivery line are constructed as collecting stations for the superimposed stacking of successively delivered layer units, whereof at least one has a support, which is raisable and lowerable independently of at least one further transfer station, then numerous different operations are possible and e.g. successive transfer stations can be alternately supplied with layer units.

In addition, in a transfer station closer to the start of the delivery means and/or a following station can be used for the formation of individual layers to give higher overall stacks with e.g. 2500 sheets or more. However, it is also possible to deposit in a transfer station a single layer unit, which is then conveyed away, while in a further and in particular a following transfer station layer units are stacked and which are then conveyed away.

An alternating, differently high loading of successive transfer stations is also possible. Despite the further working of the delivery means, in each case, the time available for discharging from a transfer station is that which is required for the loading of a further transfer station with at least one layer unit. It has been found that in this way the output of the processing machine, which every six seconds provides a row of juxtaposed layer units at right angles to the delivery direction and which must be taken over at the start of the delivery means, can be handled without intermediate storage means, because the conveyor with the alternately inoperative and conveying transfer stations forms such a storage means. If the intermediate storage means was only formed by two raisable and lowerable, superimposed supports in the vicinity of said transfer station, during the discharge of the lower stack, at least one further layer unit could be placed above this lower stack, but then the upper support would have to be drawn out again substantially over the entire length of the layer unit secured by grippers, which can lead to displacements between the individual layers during stacking. In addition, such a construction would usually be relatively complicated and in connection with the supporting of large widths would lead to problems. The described alternating operation would only be possible with difficulty and a greater overall height would result.

Instead of, or in addition to, the described construction, the set object can also be achieved in that means are provided with which the supplied layer unit can be supported on the underside up to the precise alignment with respect to the transfer station or a layer unit already located therein. These means are appropriately constructed in such a way that, following the delivery of each individual layer unit, they are immediately retracted and several layer units are not superimposed stacked thereon. They are substantially synchronously controlled with the cycle of the delivery means when the latter is depositing in the associated transfer station.

Instead of constructing the support means in such a way that it supports the layer unit to be taken over on its entire underside, there is preferably an arrangement in which the layer unit, at least towards the end of the alignment with respect to the transfer station, is only supported on two facing marginal areas and is not supported between them. A marginal area gripped in pulling manner by a clamp can be narrower than the facing marginal region only supported on the underside and whose width is only half the associated longitudinal extension or smaller. The superimposed individual layers of the layer unit are consequently securely held in their flush position, being moved in contact-free manner over the support of the transfer station and then, after retracting the support that only acts on the underside of the layer unit, firstly said associated marginal area is deposited on the support. Only then is the gripper or clamp opened and retracted in the opposite direction, so that also this marginal area is deposited.

If the support acting on the stack underside is substantially in one piece in thin plate-like manner and free from belts, rollers, etc. over its thickness, then it can have a thickness of only a few millimeters. In addition, in the support position, it can be supported in freely projecting manner on the top of the support or the top layer unit, without having to be supported in its lateral area up to its front end with respect to the frame. It can also be kept substantially contact free with respect to the support or the top of the already transferred layer unit by a gap.

The means for the sliding overtravelling of a transfer station can form the means for the sliding support of a following transfer station and consequently alternately act with one end as a moving bridge and with the other end as a support bridge or an upper shield for the deposited layer units.

In accordance with the inventive method, layer units are successively delivered to separate transfer stations or separately conveyed away by the latter. These working sequences can be so interlinked that alternately one transfer station is loaded and the other unloaded. The delivery takes place in a conveying plane, which is defined by the underside of the layer unit during delivery. The transfer takes place in a bearing plane, which is defined by the underside of the layer unit after transfer and is formed by the bearing plane of the transfer station or the top of a layer unit already located on the bearing plane. When the transfer station is not occupied, during the overtravelling with a layer unit, its bearing plane can be roughly located in the conveying plane. However, if said bearing plane is formed by the conveyor belt of a transverse conveyor, it is appropriately slightly lowered, so that it will not or will only slightly be in contact with the overtravelling layer unit. This also applies in the case that an already transfer red layer unit is overtravelled.

BRIEF DESCRIPTION OF THE DRAWINGS

These and other features can be gathered from the claims, description and drawings. Embodiments of the invention are described hereinafter relative to the drawings, wherein show:

DETAILED DESCRIPTION OF THE PREFERRED EMBODIMENTS

Figures 1, 4, 5, 6:
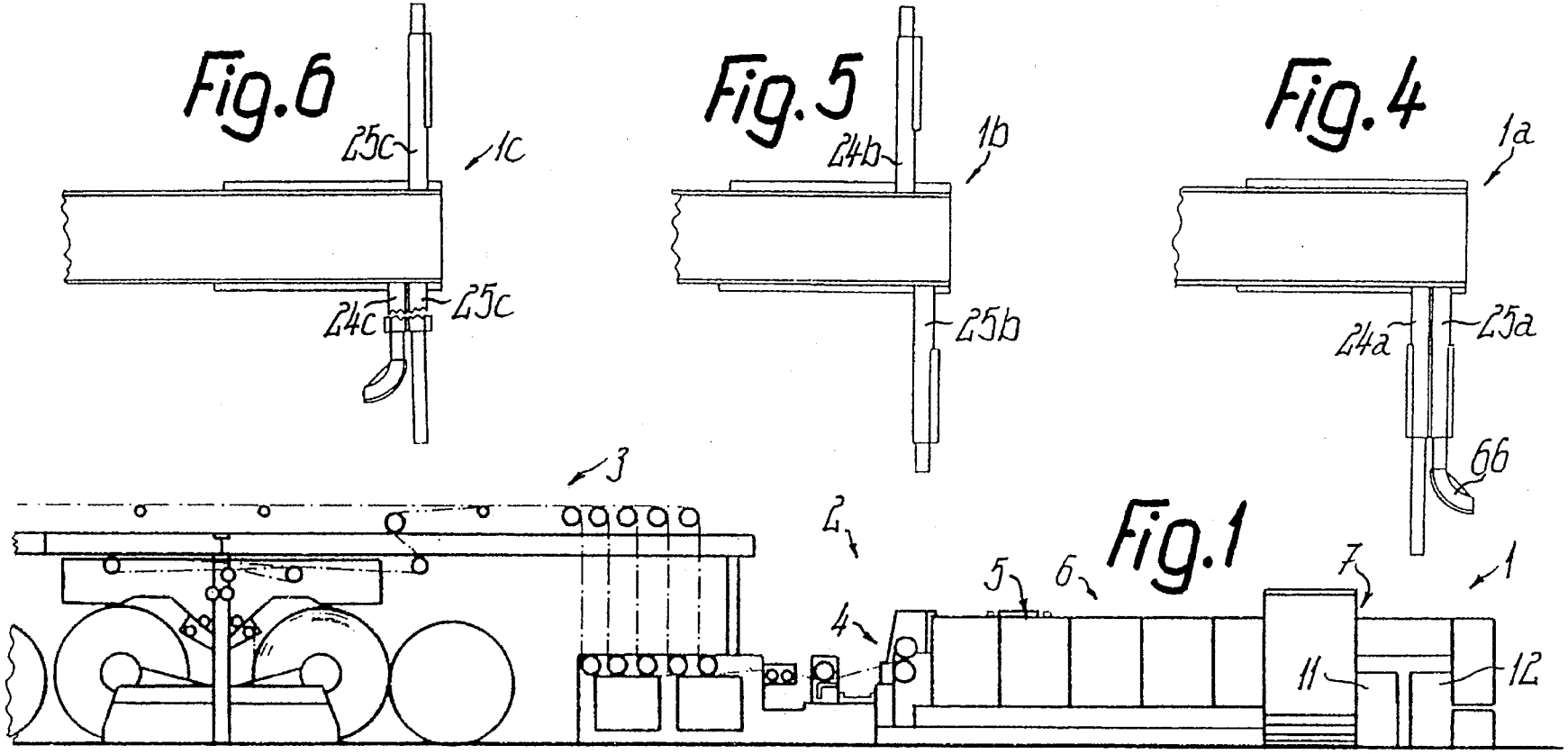
FIG. 1 An inventive conveyor means on a processing machine.
FIGS. 4 to 6 Further embodiments of the conveyor means in plan view.

The conveyor means 1 is positioned at the end of a paper processing machine 2, which is supplied from paper rolls of a web supply means 3 with successive paper webs. A longitudinal cutter 4 of the processing machine 2 cuts the paper webs in waste-free manner into size-maintaining longitudinal strips, which are then subdivided by a cross cutter 5 into juxtaposed partial stacks. Further stations 6, which are used e.g. for discharging faulty layers, the overlapping of successive layers and the stacking of partial layers to form layer units are successively traversed by the layers. At the end of these stations, in each case, a row of juxtaposed layer units reaches the discharge station of the processing machine, where they are taken over by the conveyor means 1.

Figure 2:
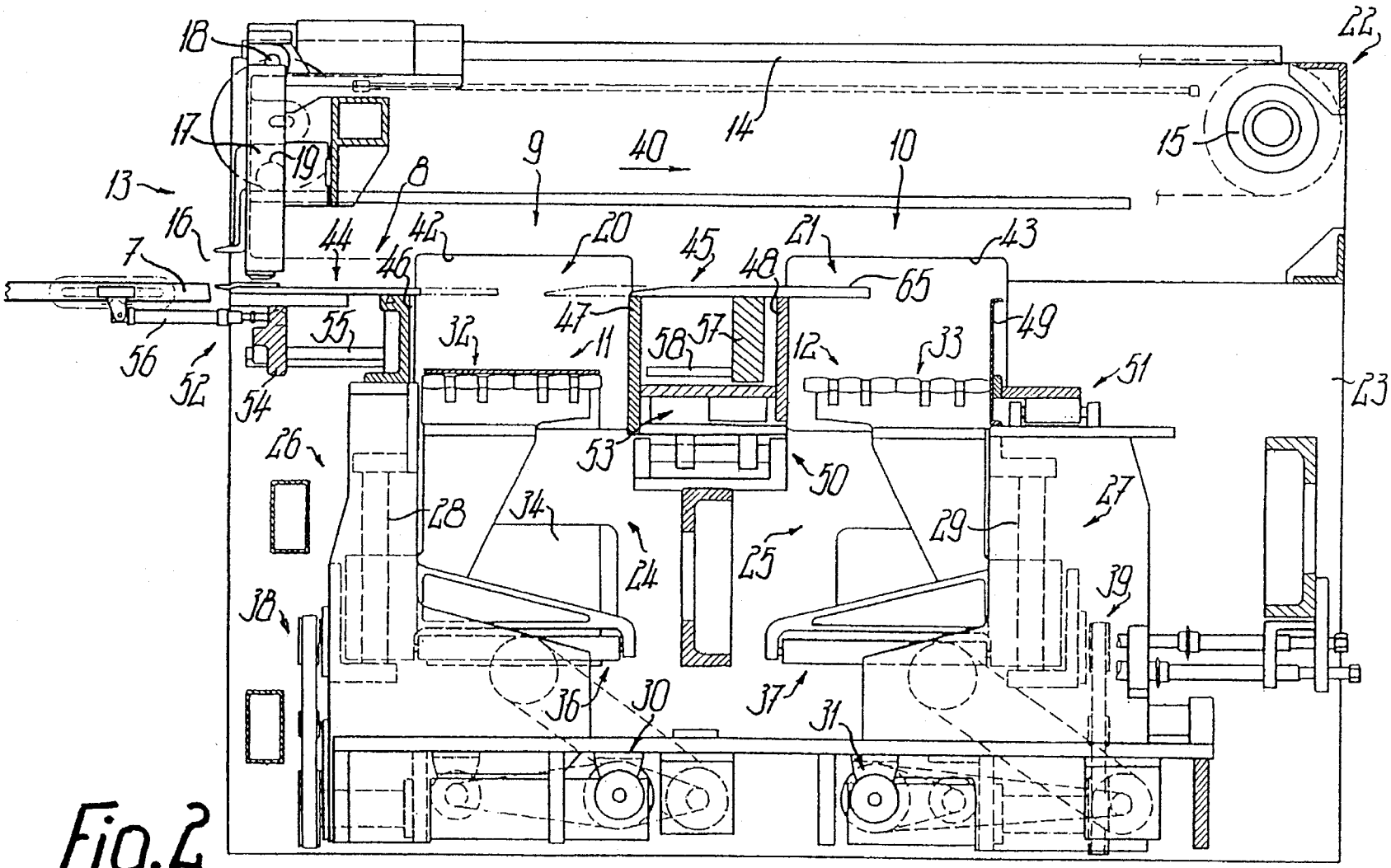
FIG. 2 The conveyor means in longitudinal section.

Referring to FIG. 2, the takeover takes place by a delivery means 8, which appropriately transfers all the juxtaposed layer units simultaneously and synchronously continuing the movement direction of the processing, machine 2 to the transfer stations 9, 10, which are positioned successively in this direction and in each case have a plurality of juxtaposed transfer points corresponding to the number of juxtaposed layer units. From the transfer stations 9, 10, the layer units are conveyed independently of one another via discharging means 11, 12, e.g. to separate packing means. The juxtaposed layer units simultaneously located in the particular transfer station 9 or 10 can be conveyed away together or individually or in groups in the same or opposite directions.

For the taking over of the furthest forward layer unit from the discharge station 7 a conveyor 13 is provided, which simultaneously engages all the juxtaposed layer units of a cross cut row then conveys them towards the first transfer station 9 and does not take over the layer units individually or in groups with independently movable individual conveyors. The conveyor 13 has a guide located above the transfer stations 9, 10 as well as a drive 15, which e.g. by means of a toothed belt drive moves juxtaposed grippers for the layer units in reciprocating linear manner along the guide 14. All the pneumatically operated grippers 16 can be located on a common base or pedestal 17, which is pivotably mounted with respect to a travelling carriage mounted on the guide 14 and about a shaft roughly parallel to the conveying plane and roughly at right angles to the conveying direction above the grippers 16. On moving in the conveying direction and if the gripper 16 encounters an excessive resistance, the base 17 is freed counter to the force or tension of a locking overload protection and is released in upwardly pivoting manner about the pivot shaft 18 counter to the conveying direction and a contact, operated as a result of this, stops the conveyor means. The drive 15 is provided with a torque-dependently operating overload protection, which disengages if, on moving counter to the conveying direction, the grippers 16 encounter an excessive resistance. The base 17 hung on the pivot shaft 18 can be supported with an underlying rotor 19 formed by a roll or the like on a guide rail from which the rotor 19 lifts the base 17 pivots out.

At least in the vicinity of each transfer station 9, 10, which is followed by another transfer station in the delivery direction, a moving bridge 20 or 21 can be moved and by means of which the conveyor 13 can convey away the gripped layer units so that either the associated transfer station 9 is overtravelled and the layer units are aligned with the associated transfer station 10.

The conveyor means 1 has a frame 22 with two lateral side plates 23 on whose facing insides are guided the running carriage of the conveyor 13 and the rotor 19, together with the moving bridges 20, 21. Each transfer station 9 or 10 has associated with it at least one transverse conveyor 24 or 25, which traverses one or both side plates 23 and is substantially located below the common, roughly horizontal running plane of the moving bridges 20, 21. The transverse conveyors 24, 25 are mounted with separate lifting devices 26, 27 independently of one another and in raisable and lowerable manner on lifting guides 28, 29, which are laterally located on remote sides of the transverse conveyors 24, 25. With each lifting device 26, 27 is associated a separately controllable lifting drive 30 or 31, which can be formed by a mechanical or pressure-operated drive and appropriately is provided not between the facing sides of the lifting devices, but instead below the same and/or on their remote sides.

Each transfer station 9, 10 or their transverse conveyors 24, 25 forms a support 32, 33 for the layer units to be transferred. Each support is formed by the upper side of a separate conveyor belt 34, 35 (See FIG. 3), which runs over a belt guide 36 or 37, which is raisable and lowerable with the associated lifting device 26 or 27. With each conveyor belt is associated a separate belt drive 38 or 39, which appropriately drives from the side remote from the adjacent belt guide 36, 37 and is located on said side. Thus, the two belt guides 36, 37 can project freely at right angles to the associated conveying direction from the guide and drive side, so that the conveyor belts 34, 35 can be easily drawn off and replaced from the area between the transverse conveyors 24, 25.

The delivery means 8 defines a conveying direction 40 and the discharging means 11, 12 formed by the transverse conveyors 24, 25 defines a discharge direction at right angles thereto and which is also roughly horizontal. Both the transverse conveyors 24, 25 can convey roughly parallel to one another, but optionally, in different planes. The conveying away takes place from the transfer stations through window-like passages 42, 43 in the side plates 23, which can be provided in one or both plates. Each transfer station 9, 10 can consequently convey away in at least two directions.

The moving bridge 20 of the transfer station 9 closer to the discharge station 7 is formed by two facing bridge parts 44, 45, which can be so moved against one another in an overtravelling position indicated in dot—dash line in FIG. 2, that they either mesh together or strike against one another, or are located projecting freely by roughly the same amount at a relatively small distance from one another. Each transfer station 9 or 10 is bounded by roughly vertical boundaries 46, 47 or 48, 49 in shaftlike manner at its sides transverse to the direction 40 and the internal spacing corresponds to the size of the layer units. At least one, and in particular, the second boundary 47 or 49 in the direction 40 is adjustable with a setting device 50 or 51 to different sizes roughly in the direction 40 and both boundaries 47, 49 can be separately adjustable by means of a common control drive. The transverse conveyors, boundaries and/or moving bridges can also be provided on a carrier, which is adjustable roughly in direction 40 with respect to the frame 22 or the passages 42, 43, as well as the conveyor 13.

By means of a separate setting device 52, 53, each bridge part 44, 45 can be adjusted and fixed by means of a control mechanism reciprocating roughly in direction 40. The bridge part 44 has a fixed part extending roughly to the output or discharge station 7 and a part adjustable with the setting device 52, which in the starting position terminates roughly flush with the boundary 46 and is located immediately on the top thereof. From said starting position, this portion of the bridge part 44 can be slid in direction 40 in contact-free manner over part of the width of the support 32. For this purpose, the displaceable portion is located on an underlying carriage 54 formed by a cross-beam on the outside of boundary 46 and which is guided in guides 55 on the insides of the cross plates 23 and is displaceably controlled by drives 56, e.g. working cylinders located in the vicinity thereof. A corresponding carriage 57 or cross-beam located below the integrally displaceable bridge part 45 is displaceably mounted in guides 58 located roughly at the same height and with drives 59 independently of the bridge part 45 in and counter to the direction 49, while also being fixed to the associated bridge part 45. This carriage 57 is located in the gap between the boundaries 47, 48 and on the underside of the bridge part 45. The guide for the setting device 50 can be located immediately below it.

Each bridge part 44 or 45, which simultaneously forms a running path between the discharge station 7 and the transfer station 9 or between the two successive transfer stations 9, 10 aligned in direction 40, has slot-like running gaps 63, 64, extending in the direction of arrow 40, for the lower gripping arms of the grippers 16. The conveyor 13 has a number of grippers 16 at least corresponding to the number of juxtaposed layer units and can be simultaneously controlled by means of a common drive. The gripping surface of each lower gripping arm is roughly located in the conveying plane defined by the top of the running paths, so that the gripping arm at least partly engages in the associated running gap 63 or 64. For this purpose, the bridge part 44, 45 is formed by plate-like guide fingers 60, 61 juxtaposed with the gap spacing and which are transversely adjustable and fixable with respect to the associated carriages 54, 57 for spacing adjustment purposes. In the case of the bridge part 44, in each case, one guide finger 60 is telescopically displaceably mounted in the underside of a fixed cover plate 62, which is in turn supported in transversely adjustable and fixable manner on a cross-brace adjacent to the boundary 46 and linking the side plates 23. The guide fingers 60, which are narrower than the cover plate 62, can be widened towards their free ends. For each transfer point of each transfer station a separate bridge part or guide finger and/or separate cover plate is consequently provided.

For each transfer station 9, 10 and in particular the last transfer station 10, in direction 40 is provided at least one plate-like support arm 65, which can be so moved in direction 40 over the associated support 33, that is spacedly engages over the same at least over part of its width. The end of the layer unit facing the gripper 16 can be supported on the support arm 65 until it is aligned by the conveyor 13 relative to the support 33. After this, the support arm 65 is again retracted over the boundary 48, so that the layer unit can drop down to the support 33 or on to a layer unit already positioned thereon. The support arm 65 is formed by the end of the bridge part 45 remote from the transfer station 9 or is rigidly connected thereto in operation, so that, like the guide finger 61, it is formed by support fingers between which are located running gaps 64. Thus, in one displacement position, the bridge part 45 is in the vicinity of the transfer station 9 for forming the moving bridge 20, while in the other position, it is in the vicinity of the transfer station 10 for forming the support arm 65. The guide finger 60 can form the corresponding support arm in the vicinity of the transfer station 9.

Using the conveyor means, working appropriately takes place according to the following method. The layer units, which can optionally be collected from smaller layers at the discharge station 7 are spaced in a transverse row and are simultaneously engaged by the conveyor 13 at their front transverse edges and are linearly drawn in direction 40, while the moving bridge 20 is located in the closed position indicated in dot-dash like manner in FIG. 2. Thus, the layer units can be moved as one through the delivery region of the transfer station 9 without delay or stopping. In order that the rear marginal region of the drawn layer unit slides adequately over the gap between the bridge parts 44, 45, the top of the bridge part 45 drops away in ramp-like manner at the associated end.

As soon as the rear transverse edge of the layer units has reached a distance from the free end of the support arm 65 which roughly corresponds to its displacement distance to the support position, the bridge part 45 is also moved in the direction 40 via the setting device 53. Consequently there is no further relative movement between the layer units and the support arm 65 until the layer units are located in oriented and completely contact-free manner over the support 33 raised to directly below the support arm 65. The latter is then retracted in opposition to direction 40 until flush with the boundary 48, so that the associated trailing marginal area of the layer unit drops down on to the support 33, while the leading marginal area is kept slightly higher by the fixed gripper 16. Immediately thereafter, the gripper 16 opens, moves in direction 40 roughly by the length of its gripping arms and consequently also frees the leading marginal area of the layer units to permit sinking onto the support 33. The support 33 is lowered until the top of the deposited layer unit is lower than the lowest running plane of the conveyor 13, so that the latter runs back over the layer unit counter to direction 40 and in the described manner can collect a further transverse row of layer units at the discharge station 7. Due to the withdrawal movement of the support arm 65, the bridge part 45 has been moved back into its bridge position.

It is assumed that at each transfer point of the transfer station 10 several, e.g. five, layer units have been stacked on one another and are to be conveyed away as a large stack. In the described manner, four further delivery cycles are performed, and now, on each occasion, the support arm 65 overtravels the top, already deposited partial layer. As a result of the withdrawal movement of the support arm 65, on each occasion, the bridge part 45 is brought back into it overtravel position for the transfer station 9. If now the relatively high large stack of superimposed layer stacks of a transverse row are to be conveyed away after or simultaneously with the lowering for the return of the conveyor 13, by starting up the belt drive 39 in one of the two directions 41, they are conveyed transversely out of the frame 22 and through the associated passage 43. During the time necessary for this conveying away and up to the emptying of the transfer station 10, the conveyor 13 can in the described manner collect at least one further transverse row of layer units and deposit same in the transfer station 9.

The bridge parts 44, 45 are retracted until roughly flush with the boundaries 46, 47 and the support 32 is moved directly below the running plane or underside of the bridge part 44 or the guide finger 60. During the transfer, the latter can function as a support finger in roughly the same way as described relative to the support arm 65 and the working of the gripper 16 can also take place correspondingly.

Following the corresponding lowering of the support 32, the gripper 16, whose base 17 or carriage does not have to perform any vertical movements, returns to the discharge station 7 and collects the next, furthest forward transverse row of layer units. In the meantime, the moving bridge 20 is closed and in the transfer station 10, a large stack can be formed in the described manner, while now the conveying away from the transfer station 9 takes place in one of the directions 41, so that the latter is again free when a transfer cycle for the transfer station 10 is ended.

Figure 3:
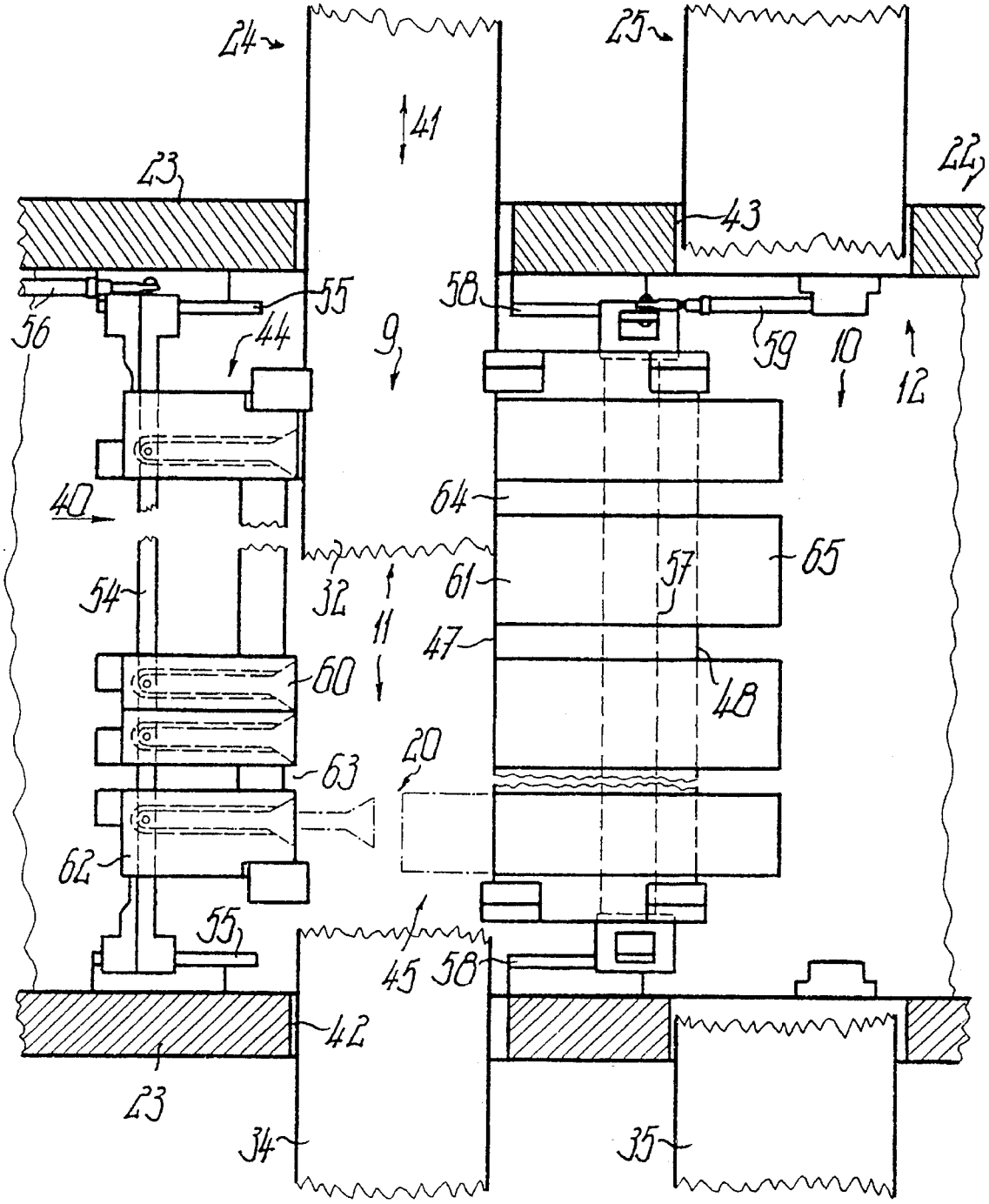
FIG. 3 Part of the conveyor means in cross-section.

According to FIG. 3, each discharge means 11 or 12 is moved out from both sides of the frame 22 and can be driven in both opposite directions 41. Thus, each discharge means 11 or 12 can convey on two separate, further processing machines or the like, e.g. packing means, which can be located on both sides of the frame 22 or the T-like conveying conveyor means 1. Also in the case of a conveyor means with only a single transfer station, it can be appropriate to divide at least one transverse conveyor 24 or 25 between two adjacent transfer points, e.g. roughly in the center of the length of a row of layer units, so that then one partial conveyor discharges in one direction and other in the opposite direction 41, and for the same conveying speed, a correspondingly shorter time is required until the transfer station is completely emptied. The layer units of the particular transverse row need not in the case of the inventive construction be drawn apart to a reciprocal spacing for conveying away purposes and instead can remain directly engaged from the discharge station 7 to the conveying away means. After or during conveying away, they can be kept spaced, e.g. by corresponding acceleration.

Whereas in the embodiment according to FIG. 3, each transverse conveyor 24, 25 allows conveying away to both sides, the conveyor means 1*a* according to FIG. 4 has all conveying away in one direction, so that the transverse conveyors 24*a*, 25*a* need only be led out to one side. Closely juxtaposed, successive transverse conveyors can be led out in spaced manner outside the conveyor means 1*a* and for this purpose e.g. one transverse conveyor 25*a* is connected to a running arc 66 for the layer units.

The conveyor means 1*b* according to FIG. 5 has a transverse conveyor 24*b* only led out in one direction and a transverse conveyor 25*b* led out in the opposite direction. In the conveyor means 1*c* according to FIG. 6 the transverse conveyor 24*c* is only led out to one side and the transverse conveyor 25*c* to both sides. Conversely the transverse conveyor 24*c* could be led out to both sides and the transverse conveyor 25*c* to only one side. It is also possible to randomly combine the embodiments according to FIGS. 3 to 6, optionally in the case of more than two successive transfer stations.

I claim:

1. A conveyor for transporting paper layer units, collectable to form paper layer stacks, said conveyor comprising:

means (8) for delivering the layer units in a delivering direction (40) in a row of paper stacks juxtaposed transverse to said delivering direction, said delivering means including grippers that pull the stacks in the delivering direction;

first and second deposit stations (9, 10), each having a layer support (32, 33) for receiving the layer units from said delivering means (8), each of said deposit stations (9, 10) having at least one boundary side (46 to 49) oriented transverse to said delivering direction (40);

means (11, 12) for discharging the layer units received by aid deposit station (9, 10);

means for alternatively transferring substantially each of the juxtaposed units of said row alternately to each of said first and second deposit stations (9, 10); and at least one running path, during at least one operating state of said conveying means said at least one running path (20, 21) being located upstream of said deposit station (9, 10) in the delivering direction, said running path connecting substantially vertically even to said boundary side (46–48) of said deposit station (9 or 10), said running path (20, 21) substantially linearly guiding and supporting the layer units when the layer units are passed along said running path and are substantially linearly transmitted from said running path to said at least one deposit station by said delivering means, wherein said transferring means receives the layer units in at least one row of juxtaposed units juxtaposed transverse to the delivering direction (40), said conveyor further comprising means for selectively transferring at least one of the layer units to a second deposit station (9, 10) located behind a first deposit station in said delivering direction (40), wherein said delivering means (8) includes a unit delivering station (7) for receiving the layer units, said delivering means having at least one delivering conveyor (13), said delivering conveyor (13) being selectively transferable from said delivering station (7) to said deposit stations (9, 10) interconnected by said running path, said at least one delivering conveyor (13) supporting the layer unit on remote sides.

2. The conveyor according to claim 1, further comprising means for passing at least one of the layer units through and over said first deposit station (9) independently of any loading state of said first deposit station (9), said running path defining a substantially planar transport plane connecting a delivering station (7) of said delivering means (8) with said first and second deposit stations (9, 10).

3. The conveyor according to claims 1, wherein said discharging means discharges the layer units in a discharging direction (41) oriented transverse to said delivering direction (40), said first and second deposit stations (9, 10) having a transverse conveyor (24, 25) and a support (32, 33) for the at least one layer unit.

4. The conveyor according to claim 1, wherein parallel to said delivering direction (40) each of the layer units has a length extension, said first deposit station (9, 10) followed by said second deposit station substantially in said delivering direction (40), a spacing existing between said first and second deposit stations (9, 10), said running path (20, 21) including at least one substantially planar running plate (60, 65), said spacing being smaller than the length extension of the layer units.

5. The conveyor according to claim 1, wherein said means for discharging the layer units can selectively discharge in opposite directions (41).

6. The conveyor according to claim 1, wherein each of said first and second deposit stations (9, 10) has a unit support for the layer units, on top of said unit support defining a layer support plane, said running path comprising at least one conveying bridge (20, 21) operably moved at least partly over said unit supports (32, 33) of said first and second stations (9, 10) into an overtravelling position for the layer units, said conveying bridge (20, 21) guiding the layer units parallel to at least one of:

a direction substantially parallel to said layer support plane; and a direction substantially parallel to said delivering direction (40).

7. The conveyor according to claim 6, wherein a bridge section (44) of said conveying bridge (20) is transferable substantially in said delivering direction (40) into said overtravelling position, said bridge section (44) being dimensionally rigidly stable.

8. The conveyor according to claim 6, wherein a bridge section of said conveying bridge (20) is telescopically extendable out of said running path.

9. The conveyor according to claim 6, wherein a bridge section (45) of said conveying bridge (20) is operationally transferable substantially counter to said delivering direction (40) into said overtravelling position, said running path connecting upstream to said first deposit station (9) and downstream to said second deposit station (10) that follows said first deposit station (9) in said delivering direction (40).

10. The conveyor according to claim 6, wherein a bridge section (45) of said conveying bridge (20) has two bridge ends selectively transferable over supports (32, 33) for the layer units of said first and second deposit stations (9, 10).

11. The conveyor according to claim 6, wherein two facing bridge sections (44, 45) are transferable toward each other into overtravelling positions freely projecting over said unit support (32) of said first deposit station (9) thereby defining an overtravelling state, said unit support (32) being provided to supportedly receive layer units in said overtravelling state.

12. The conveyor according to claim 1, wherein said running path (20, 21) has a running surface for the layer unit, said running surface having at least one running gap (63, 64) for engagingly receiving a lower gripper jaw of a gripper (16) of said delivering conveyor (13) to engage leading edges of the layer unit and to convey the layer unit by pulling.

13. The conveyor according to claim 1, wherein said delivering conveyor (13) is mounted for reversing conveying motions in substantially opposite directions, said conveyor further including at least one overload limiter for protecting said delivering conveyor against conveying overload stresses during said conveying motions in said opposite directions.

14. The conveyor according to claim 1, wherein each of said first and second deposit stations (9, 10) respectively receives the layer units from said delivering means (8) to build up layer stacks.

15. The conveyor according to claim 1, wherein a layer support (32, 33) in each of said first and second deposit stations (9, 10) is separate from the other, at least one of said layer supports (32, 33) being raisable and lowerable, said first and second deposit stations (9, 10) having independently operable discharge means (11, 12) for the layer units.

16. The conveyor according to claim 1, wherein one of said supports (32, 33) of said first and second deposit stations (9, 10) includes a belt conveyor for supportingly receiving at least one layer unit.

17. The conveyor according to claim 1, wherein said layer support (32, 33) is drive-connected with a discharge drive (38, 39) only at a lateral side, said support (32, 33) projecting freely to a side opposite laterally to said lateral side.

18. The conveyor according to claim 1, wherein there are at least two separate and adjacent discharge means (11, 12), said discharge means (11, 12) projecting freely towards each other.

19. A conveyor for transporting paper layer units collectable to form paper layer stacks, said conveyor comprising:

means (8) for delivering the layer units in a delivering direction (40), said delivering means including grippers for pulling the layer units in the delivering direction and delivering the layer units in a row juxtaposed transverse to the delivering direction;

first and second deposit stations (9, 10) each having at least one layer support (32, 33) for receiving the layer units from said delivering means (8), said deposit stations (9, 10) defining at least one boundary side (46 to 49) oriented transverse to said delivering direction (40);

a discharge means (11, 12) for discharging the layer units received by said deposit station (9, 10); and a separating means (44, 45) for conveying and supporting at least one of the layer units substantially contact-free from at least one further layer unit deposited in said deposit stations (9, 10), said separating means keeping the layer units separate until the layer units are substantially congruently aligned and superimposing the layer units by retracting.

20. The conveyor according to claim 19, wherein a separating support (45) of said separating means has at least one moveable support arm (65) substantially fully projectable over said layer support (32, 33) of said second deposit station (10).

21. The conveyor according to claim 20, wherein said support arm (65) projects in said delivering direction (40) when projecting.

22. The conveyor according to claim 20, wherein said support arm (65) is movable over said layer support (33) substantially synchronously with a delivering conveyor (13) of said delivering means (8), said support arm (65) being retractable from a position over said layer support (33) prior to receiving the layer unit from said delivering means (8).

23. The conveyor according to claim 19, wherein separating means of said second deposit station (10) convey the layer units along and past said first deposit station (9), said first deposit station being connected upstream to said second deposit station (10), and a bridge section (45) being transferrable between end positions and being located between said first and second deposit stations (9, 10) and opening one of said deposit stations.

24. The conveyor according to claim 1, further comprising an appliance frame (22), said appliance frame having passages (42, 43) for passage of discharge means (11, 12) juxtaposed in said delivering direction (40).

25. A method for conveying and discharging paper layer units including steps of:

moving the layer units by a delivering means (8) in a delivering direction, said delivering means including grippers that pull the layer units from a delivering station;

pulling the layer units in a row juxtaposed transverse to the delivering direction towards one of first and second deposit stations (9, 10);

transferring the layer units successively and selectively to each of said first and second deposit stations (9, 10); and discharging transferred layer units from said first and second deposit stations (9, 10), wherein, upstream of at least one of said first and second deposit stations (9, 10), said layer units are guided along a substantially planar running path and are continuously transmitted to said first and second deposit stations (9, 10) through a boundary side (46, 48) laterally bounding each of said deposit stations (9, 10).

26. The method according to claim 25, wherein at least some of the layer units are successively and selectively discharged from each of said deposit stations (9, 10).

27. The method according to claim 25, further comprising the steps of:

conveying at least one of said layer units past said first deposit station in a conveying plane at least in the vicinity of said first deposit station (9) higher than a bearing plane defined by a top of said first deposit station, said layer unit thereby being conveyed over and beyond the first deposit station and then being made ready for a separate discharge.

28. The method according to claim 25, wherein a bearing plane of at least one of said first and second deposit stations (9, 10) and a conveying plane of the delivering means (8) are operationally repetitively adjusted against one another by lowering said bearing plane and thereby keeping said conveying plane substantially at a same height level.

29. The method according to claim 25, wherein, during said moving step, only a furthest forward one of the layer units is moved from a delivery station by the delivery means and wherein, during said pulling step, layer units are alternately and in time sequence delivered to the first deposit station (9) and to the second deposit station (10) after being conveyed past said first deposit station (9).

30. The method according to claim 25, wherein alternately during delivering layer units to one of said first and second deposit station (9, or 10), layer units are discharged from the other of said first and second deposit station (10 or 9).

31. The method according to claim 25, wherein during at least one of:

overtravelling one of said deposit stations with at least one layer unit; and discharging at least one layer unit; said one deposit station (9) is at least partly covered on a topside and substantially in a conveying plane.

32. A conveyor for transporting paper stacks of paper sheets, said conveyor comprising:

means for delivering the paper stacks in a delivering direction, a front end of the paper stacks facing in said delivering direction, said delivering means having a plurality of transversely juxtaposed delivering grippers for gripping the paper stacks at the front end and pulling the paper stacks in said delivering direction;

first and second deposit stations, said first deposit station having a first paper support and said second deposit station having a second paper support, said first and second paper supports receiving the paper stacks from said delivering grippers, each deposit station having at least one boundary side oriented transverse to said delivering direction; and first and second discharge conveyors for discharging the paper stack received by said first and second paper support, said first and second discharge conveyors driving said first and second paper supports, wherein said delivering grippers receive the paper stacks in an orientation juxtaposed transverse to said delivering direction and convey the paper stacks, thereby providing a plurality of juxtaposed stacks juxtaposed in at least one stack row transverse to the delivering direction, including at least one stack group of at least two juxtaposed stacks, said delivering grippers alternately transferring each of said juxtaposed stacks of the stack row to each of said paper supports, at least one running path for the paper stacks substantially directly interconnecting in said delivering direction said first and second discharge conveyor and a delivering station for delivering said paper stacks to said delivering grippers, said running path at least partly forming a planar sliding path for the paper stacks, said sliding path interconnecting, substantially without gaps, said delivering station and said first paper support and said second paper support.

33. The conveyor according to claim 32, wherein said delivering means (8) includes a plurality of juxtaposed separate individual conveyors (13), said conveyors (13) conveying said juxtaposed units at least one of:

commonly as a unit group, and individually, separately to said first and second deposit stations (9, 10), at least one of said first and second deposit stations (9, 10) defining a plurality of juxtaposed transfer points, each receiving at least one of the juxtaposed units.

34. The conveyor according to claim 32, wherein, during at least one operating state of said conveyor, at least one running path (20, 21) is located upstream of at least one of said first and second deposit stations (9, 10), said running path (20, 21) being conveyingly connected to a discharge station (7) of a paper processing machine (2), which is at least one of:

a web supply means (3) for supplying a paper web in at least one layer from at least one layer roll, a longitudinal cutter (4) for dividing a paper web into longitudinal juxtaposed paper strips, a cross cutter (5) for subdividing a paper web into the layer units, an expeller for discharging faulty layer units, an overlapping means for overlapping the layer units, a stacking means for collecting the layer units to provide the layer stacks, and a cross row collecting means for successively collecting the layer units in a plurality of the unit row being located upstream of said discharge station (7).

35. The conveyor according to claim 32, wherein downstream of at least one of said first and second deposit stations (9, 10) is a means for packing the paper stacks.

36. The conveyor according to claim 32, wherein said discharge means (11, 12) discharges the paper stacks from at least one of the first and second deposit stations (9, 10) in at least one of:

different directions, opposite directions, and separately and independently driven discharge motions.

37. The conveyor according to claim 32, wherein said discharge means (11, 12) includes discharge units (11, 12) for discharging layer units from the first and second deposit stations (9, 10), at least one of said discharge units (11, 12) defining at least two juxtaposed transfer points, each receiving the layer units, at least one of said discharge units (11, 12) being subdivided between said two transfer points to include individual separate discharge conveyors.

38. The conveyor according to claim 32, wherein said first paper support and said second paper support (32, 33) for the paper stacks includes at least one of:

a support member, and a drivable discharge conveyor; said first paper support being supported in cross section so as to freely project towards said second paper support, thereby defining a service area between said first and second paper supports (32, 33).

39. The conveyor according to claim 32, further comprising means for spacing apart the paper stacks by acceleration when discharging the paper stacks with the discharge conveyors (11, 12).

40. The conveyor according to claim 32, wherein said discharge conveyors include discharge units (11, 12) extending from said delivering means (8), said discharge conveyors being separated from one another by a running arc.

41. The conveyor according to claim 32, further comprising means for adjusting said conveyor to accommodate different format sizes of paper stacks with respect to said delivering direction (40), said adjusting means including at least one of:

a control drive (50, 51);

an interconnecting drive for operably interconnecting said first and second deposit stations (9, 10); and a support adjustably mounted on a base (22) and bearing at least two of said paper supports (32, 33).

* * * * *

UNITED STATES PATENT AND TRADEMARK OFFICE

CERTIFICATE OF CORRECTION

PATENT NO. : 5,511,935

DATED : April 30, 1996

INVENTOR(S) : Seefeldt

It is certified that error appears in the above-indentified patent and that said Letters Patent is hereby corrected as shown below:

Column 9, Claim 1, line 54, replace "aid" with --said--.

Column 9, Claim 1, line 54, replace "station" with --stations--.

Column 11, Claim 11, line 10, after "first" insert --and second--.

Column 11, Claim 11, line 10, replace "station" with --stations--.

Column 11, Claim 13, line 22, replace "conveyor" with --means--.

Column 11, Claim 13, lines 23-24, replace "conveyor" with --means--.

Column 11, Claim 13, line 25, replace "conveyor" with --means--.

Column 11, Claim 19, line 65, replace "station" with --stations--.

Column 13, Claim 30, line 12, replace "station" with --stations--.

UNITED STATES PATENT AND TRADEMARK OFFICE

CERTIFICATE OF CORRECTION

PATENT NO. : 5,511,935

DATED : April 30, 1996

INVENTOR(S) : Seefeldt

It is certified that error appears in the above-identified patent and that said Letters Patent is hereby corrected as shown below:

Column 13, Claim 30, line 13, replace "station" with -- stations--.

Signed and Sealed this

Sixteenth Day of December, 1997

Bruce Lehman

*Attest:*

BRUCE LEHMAN

*Attesting Officer*

*Commissioner of Patents and Trademarks*